US006860448B2

(12) United States Patent
Rastegar

(10) Patent No.: US 6,860,448 B2
(45) Date of Patent: Mar. 1, 2005

(54) DEPLOYABLE PROJECTILES

(75) Inventor: Jahangir S. Rastegar, Stony Brook, NY (US)

(73) Assignee: Omnitek Partners, LLC, Bayshore, NY (US)

( * ) Notice: Subject to any disclaimer, the term of this patent is extended or adjusted under 35 U.S.C. 154(b) by 0 days.

(21) Appl. No.: 10/236,004

(22) Filed: Sep. 4, 2002

(65) Prior Publication Data

US 2003/0126978 A1 Jul. 10, 2003

Related U.S. Application Data

(60) Provisional application No. 60/317,308, filed on Sep. 5, 2001.

(51) Int. Cl.[7] ..... F42B 15/01; F42B 15/10; F41G 7/00

(52) U.S. Cl. ..... 244/3.27; 244/3.1; 244/3.11; 244/3.15; 244/3.24; 89/1.11; 102/473; 102/501

(58) Field of Search ..... 102/473, 489–501; 244/3.1–3.3, 158 R, 158 A, 159–173; 372/61, 62; 89/1.11

(56) References Cited

U.S. PATENT DOCUMENTS

| | | | | | |
|---|---|---|---|---|---|
| 3,560,971 | A | * | 2/1971 | Alsberg et al. | 342/62 |
| 4,380,013 | A | * | 4/1983 | Slysh | 244/173 |
| 4,848,208 | A | * | 7/1989 | Kosman | 89/1.11 |
| 5,108,046 | A | * | 4/1992 | Chaumette et al. | 244/160 |
| 5,108,047 | A | * | 4/1992 | Puech | 244/160 |
| 5,826,821 | A | * | 10/1998 | Brandon et al. | 244/3.27 |
| 5,871,173 | A | * | 2/1999 | Frank et al. | 244/3.27 |
| 6,511,016 | B2 | * | 1/2003 | Bar et al. | 244/3.24 |

* cited by examiner

*Primary Examiner*—Bernarr E. Gregory

(57) ABSTRACT

A method for protecting a second location against a first projectile fired from a first location at the second location. The method includes: firing at least one second projectile toward the first projectile; and deploying one or more projections from the second projectile to increase its footprint and increase the probability of destroying or changing the trajectory of the first projectile.

13 Claims, 3 Drawing Sheets

DEPLOYABLE PROJECTILES

CROSS-REFERENCE TO RELATED APPLICATION

This application claims priority to earlier filed U.S. provisional application, Ser. No. 60/317,308 filed on Sep. 5, 2001, the entire contents of which is incorporated herein by its reference. This application is related to application Ser. No. 10/236,063, filed Sep. 4, 2002, now abandoned, entitled "Deployable Bullets" the contents of which are incorporated herein by its reference.

BACKGROUND OF THE INVENTION

1. Field of the Invention

The present invention relates generally to projectiles, and more particularly, to missiles and other projectiles, which have deployable blades to increase its footprint and/or decrease its momentum.

2. Prior Art

Numerous systems have been developed or are under development for protection against various threats such as missiles or projectiles. In certain systems, particularly if weight is not a major problem, a properly designed passive or active armor may provide adequate protection. In other systems, an incoming missile may be defeated by a super-high rate of small to medium caliber fire in either a pure kinetic mode or with the assistance of high explosives. Guided missiles of various kinds have also been developed for such purposes. A number of smart or guided projectiles are also under development for such applications. Many of such protection systems are or planned to be used in combination.

A review of the existing protective systems clearly indicate the lack of any effective measures against weapons such as shoulder fired RPG type of weapons, particularly those fired at very close range, such as from a 50 meter radius. No such weapons have been planned nor are under development. The development of such protection systems is essential for all lightly armored vehicles such as FCS, particularly for those that are to be used in missions within urban environments. Such protection system may also be used on helicopters and other mobile platforms, on fixed command posts and/or various facilities.

SUMMARY OF THE INVENTION

An objective of the present invention is to provide novel projectiles that effectively defeat shoulder fired rockets or the like within a radius of 50 meters. A number of different versions of such interceptors are provided herein and their general merits and shortcomings for different modes of application, such as method of launch and available sensory information are discussed. The preferred interceptor designs are totally mechanical and passive and do not carry any explosives. The proposed designs are, however, naturally suitable for development into projectiles that are significantly more destructive to the target by the addition of relatively small but directional explosive charges without requiring sophisticated electronics and sensory gear and requiring any means of tracking, and/or guidance and control. It is, however, shown that the projectile and its means of delivery can be made smarter in a step by step manner by the addition of on-board sensory, decision making (microprocessors), and/or means of guidance and control. In this regard, the novelty of the proposed interceptors and means of delivery is that the basic and bare projectile is still a highly effective protective weapon and that its effectiveness and performance can be incrementally enhanced by the addition of the aforementioned components and that it can eventually be turned into a very smart and extremely effective weapon against shoulder fired missiles and the like that are fired from very close range.

In addition, the provided projectiles and their means of delivery may be used as a supplement to the existing anti-missile protection systems as the last protective weapon to be used if all other weapons fail to stop or divert the incoming missile.

The main characteristics of the provided innovative interceptors include: The intercepting projectile is fired from a regular gun; The intercepting projectile may be fired from a rifled or smooth bore barrel; The intercepting projectile deploys into a propeller-like interceptor rotating at high speeds; By deploying the intercepting projectile into a spinning propeller, the probability of hit is increased by orders of magnitude; The intercepting projectile fired from smooth bore gains its spinning speed by the aerodynamic forces acting on the propeller; The firing speed and spin rates determine the mode of flight from high drag "free spinning" flight to low drag air-screw modes of flight; In the totally passive mode of operation, the target is either destroyed or knocked out of course; The propeller that hits the target can be used as a trigger to properly detonate a directional charge to defeat the target; On-board target seeking sensors may be added to the intercepting projectile to optimally time the deployment of the propeller to achieve maximum rotational speed at the time of target impact; Relatively simple guidance and control actuation may be added to the intercepting projectile (propellers) to guide the projectile towards the target; and One-way means of communication between a "ground" station (the vehicle to be protected) and the intercepting vehicle can be added for guiding the projectile towards the target.

Accordingly, a method for protecting a second location against a first projectile fired from a first location at the second location is provided. The method comprising: firing at least one second projectile toward the first projectile; and deploying one or more projections from the second projectile to increase its footprint and increase the probability of destroying or changing the trajectory of the first projectile.

The method preferably further comprises tracking the first projectile and directing the at least one second projectile towards the first projectile.

Preferably, the deploying step deploys two or more air blades to either hover the second projectile or propel it towards the first projectiles.

Preferably, a plurality of second projectiles are fired toward the first projectile.

The method preferably further comprises detonating a charge on a surface of at least one of the one or more projections which makes contact with the first projectile.

Also provided is an interceptor projectile for protecting a second location against a first projectile fired from a first location at the second location. The interceptor projectile comprises: a shell; one or more deployable projections movably support by the shell between closed and deployed positions; and deploying means for deploying the one or more projections to increase the footprint of the interceptor projectile and increase the probability of destroying or changing the trajectory of the first projectile.

The interceptor projectile preferably further comprises means for tracking the first projectile and means for directing the interceptor projectile towards the first projectile.

Preferably, the one or more projections comprises two or more air blades, wherein the means for deploying comprises means for deploying the two or more air blades to either hover the interceptor projectile or propel it towards the first projectiles.

The interceptor projectile preferably further comprises a plurality of interceptor projectiles fired toward the first projectile.

The interceptor projectile preferably further comprising an explosive charge disposed on a surface of at least one of the one or more projections and means for detonating the explosive charge upon contact with the first projectile.

Preferably, one or more projections are rotatably disposed on the shell and the deploying means comprises biasing means for pivoting the one or more projections outward radially after firing from a firing tube.

The deploying means alternatively comprises means for centrifugally deploying the one or more projections upon the spinning of the shell.

In another alternative, the deploying means comprises: the one or more projections being slidably disposed in a cavity of the shell and being fabricated from a flexible material; at least one weight slidable with the one or more projections; a slot corresponding to each of the one or more projections, the slots being disposed on an exterior of the shell and in communication with the cavity; and directing means for propelling and directing the flexible blades from the cavity and through the slots to project from the shell upon firing of the interceptor projectile. Preferably, the directing means comprises a curved portion disposed in the cavity and proximate to the slots, the curved portion having a curved surface which directs each of the projections to a corresponding slot, the weight being slidable towards the slots upon acceleration of the interceptor projectile. Alternatively, the directing means comprises a curved portion disposed in the cavity and proximate to the slots, the curved portion having a curved surface which directs each of the projections to a corresponding slot, the weight being slidable towards the slots upon detonation of a charge.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Figure 1:
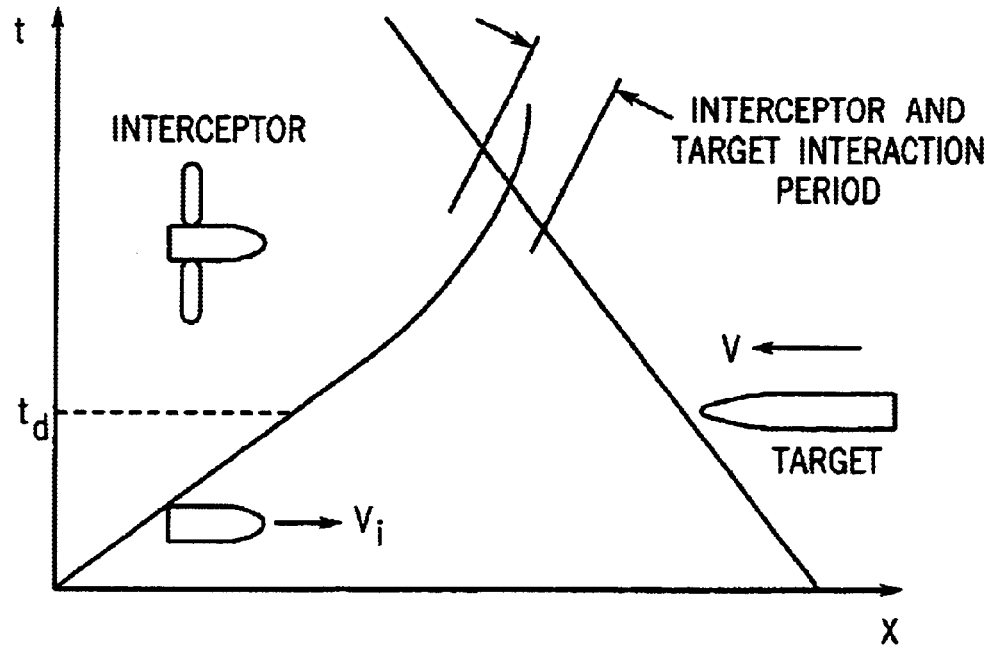
FIG. 1 illustrates a graph showing a trajectory of an intercepting projectile and a target projectile and the process of interceptor projectile deployment and interception.

The novel intercepting projectiles (alternatively referred to herein as "interceptors") and their means of delivery for effectively defeating shoulder fired rockets or other similar weapons that are fired from very close range, in the order of a 50 meters radius, will now be described in detail. The basic operation of the systems and methods of the present invention for target interception and target defeat will then be described.

Consider an incoming projectile or missile (target) with a cross-sectional area A (radius r) that is traveling at a speed of V. An intercepting projectile is launched that would deflect or destroy (defeat) the target at an interception distance, L, say about 40 meters.

Let the interceptor projectile be traveling at a speed of $V_i$ and a have a cross-sectional area $A_i$ (radius $r_i$). Also let the closest distance from the center of the target to the center of the intercepting projectile be d. In order to maximize the probability of intercept the following observations are true.

In order to achieve an interception, the distance d must be smaller than the difference between the radii of the interceptor and the target, i.e., $$d \leqq r_i - r \tag{1}$$

To increase the probability of interception, either the distance d has to be made small or the cross-sectional area of the intercepting projectile $A_i$ (i.e., the radius $r_i$) has to be made large. Attempt is obviously always made to fire as close as possible in the direction of the incoming target. However, making the distance d small as compared to the radius of, for example, a medium caliber projectile is technically very challenging, particularly since due to the very short travel distances, minimal time is available to even achieve considerable course correction if a very smart intercepting projectile is fired at the target. By increasing the radius $r_i$ of the intercepting projectile, the probability of hit is significantly increased since the cross-sectional area $A_i$ of the intercepting projectile is proportional to the square of its radius. However, the latter option means firing a very large caliber projectile at the target, which is obviously impractical.

The interaction time t during which the interception can occur, i.e., the time during which the target and the intercepting projectile are side by side longitudinally, is proportional to the sum of the lengths of the target l and the intercepting projectile $l_i$ while being inversely proportional to the sum of the corresponding two velocities V and $V_i$, i.e., $$t \leqq (l+l_i)/(V+V_i) \tag{2}$$

In order to increase the probability of intercept, i.e., interaction between the target and the intercepting projectile, the interaction time t has to be maximized. The only parameters that can be manipulated here are the velocity of the intercepting projectile $V_i$ which should be made as small as possible, and the total length of the intercepting projectile $l_i$ which should be made as long as possible. The length of the intercepting projectile cannot be made to be too long, particularly since when using a propeller type of interceptor, since the "thickness" (longitudinal dimension) of the propellers cannot be excessive. An intercepting projectile with a slow linear velocity would, however, make the aforementioned interception distance L (the distance away from the system or structure that is to be protected and at which the interception occurs) too small.

It is, therefore shown that the probability of intercept is maximized by using intercepting projectiles that have large cross-sections $A_i$ and travel at relatively slow speeds. However, both prospects have serious drawbacks since they require that very large caliber projectiles to be fired at the target which is to be intercepted a very short distance from the vehicle or other systems or structures to be protected.

The novel intercepting projectile concepts disclosed herein are readily shown to achieve all the advantages of large cross-section and slow moving intercepting projectiles while all their shortcomings are avoided. This is the case since the provided intercepting projectiles are designed with the following basic characteristic: The proposed intercepting projectiles have varying cross-sectional area $A_i$, varying linear velocity $V_i$, and varying spinning rate $\omega$ (angular velocity about the longitudinal axis of the projectile). The proposed intercepting projectiles are launched (fired) with small cross-sectional areas at high speeds. As the intercepting projectile approaches the incoming target, its effective cross-sectional area is increased significantly, while its linear velocity is decreased and its spinning rate is increased. The presence of sensory information that can be used to trigger the above process when the intercepting projectile is at an optimal distance from the target would obviously enhance the effectiveness of the interception.

The above basic characteristics that the intercepting projectiles are desired to have can be readily achieved by the novel designs that are being proposed. In general, the following two basic design options are available.

I a first implementation the projectiles is windmilled. In windmilling, an intercepting projectile is launched from a small or medium caliber gun barrel. The projectile is constructed with a set of deployable propellers that are spring loaded. The propeller release mechanism will be fast acting, preferably based on detonation of a small charge.

Due to the short distance to the point of target interception, the optimal exit velocity is expected to be high but subsonic. The projectile is preferably launched from a rifled gun and is therefore spinning as it exists the muzzle. If a smooth bore barrel has to be used, for example to ensure the survival of the deployment mechanism and components or as may be required when sensors and electronic gear are added to make the projectile more smart, then fins have to be added to ensure projectile stability. The required spinning rates may then be induced partially by the fins and the aerodynamic design of the projectile and by the propeller themselves.

At an optimal distance from the target, the propellers are deployed to increase the effective cross-sectional area to equal the span of the propellers. The propellers would then windmill, creating drag and slowing the interceptor. The spinning rate of the projectile is also increased.

To describe the methods and devices of the present invention in more detail, FIG. 1 illustrates a sketch of the trajectories of the incoming projectile (target) and the interceptor. In this illustration, time t is plotted on the vertical axis and the horizontal distance X from the location that is to be protected (i.e., where the interceptor is launched) is plotted on the horizontal axis. Obviously we are in three-dimensional space, but for such short distances and times, a one-space-plus-time problem is a good approximation.

The trajectory of the incoming projectile is approximated by the straight line (constant velocity) with a slope 1/V, where V is the velocity of the incoming targeted projectile. The time of impact at the protected object if there were no interception would then be $t_{im}$=X/V, which sets the time scale for the present problem. Here, X is considered to be the distance at which the intercepting projectile is fired at the target. For example, if the velocity V is 150 m/s (Mach=0.5) and the distance X is 50 m, then the characteristic time is about ⅓ of a second.

At the time $t_d$, a number of radial arms (airscrew) unfold, hinged aft. These arms are airfoil shaped in their cross-section. They act as a windmill, deriving torque from the axial flow. The axial flow velocity is the speed of the intercepting projectile. Thus, the transient effect of unfolding the radial arms is to reduce the linear momentum of the projectile (slow it down) and increase its angular momentum (spin it up). The end of the transient is then when there is no exchange of momentum, i.e., when the airscrew is essentially an anemometer. Of course, overall aerodynamic drag will cause both linear and angular momentum to decrease in time, but on a longer time scale.

The intercepting projectile may be spinning from being fired from a rifled barrel, in fact, the initial rotational (spinning) velocity is a design parameter of the problem. This rotational velocity must, however, be such that there is a windmilling effect.

After deployment, there is the spin up and linear velocity slowdown phase, which is shown in FIG. 1 as the slope becoming more vertical.

After the deployment and linear velocity slowdown and spin up phase comes the intercept phase. During the time before the intercept phase begins, two events must occur: (1) The speed of the projectile interceptor $V_i$ should be slowed to a speed much smaller than the target velocity V. This will maximize the intercept time; and (2) The projectile interceptor should have an angular speed (spin rate) such that one of the blades (radial arms) will hit the incoming projectile during the intercept phase. The overall blade diameter should be large enough to maximize an intercept.

The linear and angular speeds are preferred to be more or less constant during the intercept phase. Thus, during the intercept phase, if the intercept time t, equation (2), times the angular speed of the interceptor $\omega$, times the number of airscrews, n, is larger than $2\pi$, the interceptor has increased its effective length $l_i$, thereby the intercept time t is significantly increased.

The probability of a blade of the interceptor touching the incoming projectile (target) is 100 percent if the distance between centerlines of the two objects, d, is less than the difference between their radii as indicated by the relationship (1).

As pictured in FIG. 1, the windmill should be aft of the center of gravity for longitudinal stability, i.e., the windmill should pull the interceptor backwards.

A simple mathematical model of the interceptor after deployment involves two forms of Newton's second law, one for the linear motion and the other for the angular motion.

$$m\frac{dVi}{dt} = -D(V,\alpha) \tag{3}$$

where D is drag due to transferal of linear momentum to torque, which is a quadratic function of the velocities, and will decelerate the interceptor, and $\alpha$ is a drag parameter.

This drag will then provide a positive torque, with efficiency $\epsilon$ and radial length $r_0$ that will spin up the interceptor. A detonation for a planar blast is preferably triggered when an air blade contacts the incoming projectile. A significantly more effective method is to sense the location of the propeller that strikes the target to trigger a directional charge.

In the most "passive" design, the propellers would be spring-loaded and deploy at a preset time following launch. There are a number of scenarios of intercept that we shall examine. Such scenarios result due to, for example, variations in the initial distance (the distance of the target from the location to be protected as the interceptor is fired), distance of intercept, speed of incoming projectile, and the charge necessary to deflect or destroy the target. The problem is therefore a multi-objective design problem.

Some design parameters are: The initial spin rate of the interceptor; The number of airscrews and possibility of more than one layer; The initial velocity of the interceptor; Propeller deployment time; and Means and method of detonating the charge, the type of charge and the detonation related parameters. These parameters suggest the various degrees of "smartness" that can be built into the target interception system, from the dumbest of all being that all the parameters are statically preset, through being preset at launch, to be controlled via sensory information and onboard microprocessors continuously during flight. The pitch of the blades may also be varied for optimal action.

The intercepting projectile preferably has a typical projectile shape, i.e., a body of revolution with an ogive bow.

The primary advantages of the windmill type of interceptors are that: (1) Because of the increased cross section, a less sophisticated aiming mechanism is needed; (2) No actuators or on board electronics are necessary; (3) No tracking of interceptor is required; (4) Only detection of incoming projectile is required; (5) A bank of such devices could be fired simultaneously; (6) The rapid-fire multi-barrel gun can fire a "wall" of interceptors at the target to assure successful intercept; and (7) The intercept projectiles and their means of delivery may be made incrementally "smarter" and more lethal.

Whirlybird Deploying Interceptor Projectile

A simpler concept would have a constant interceptor area $A_i$ in time, with the interceptor launched as a whirlybird. Using a torsional spring to spin the intercept projectile at launch. Thrust is generated by the spinning propellers. Following launch, the spinning rate and the linear velocity may be significantly increased by firing appropriately positioned shots. In comparison with the previous option, the linear velocity $V_i$ would be low, hence the intercept distance L will be small. This concept is for objects that have some other means of protection, such as a light armor, or have a relatively small profile so that by minimally deflecting the target, collision could be avoided.

Figure 2:
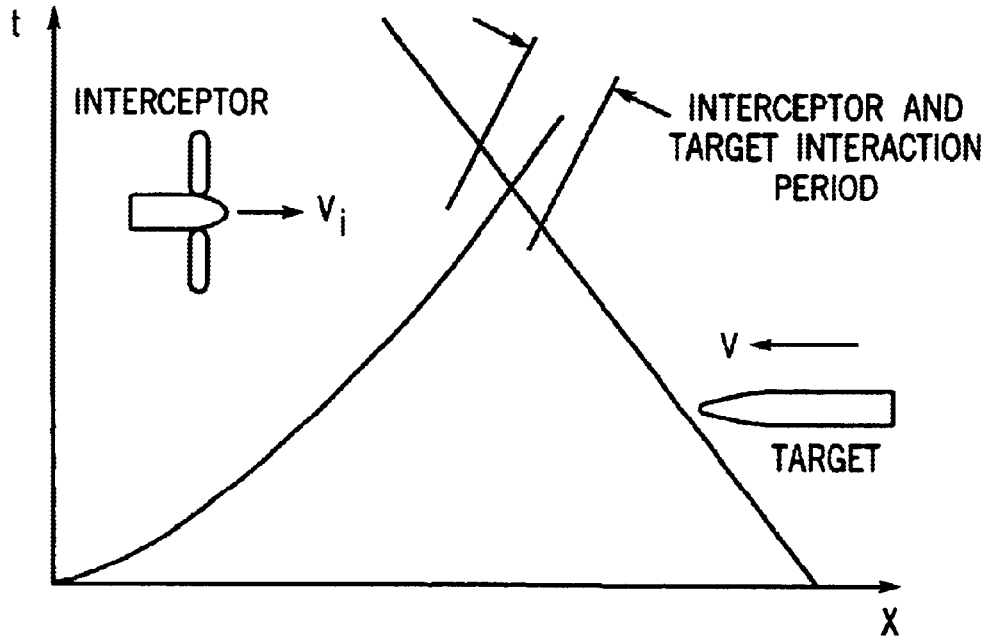
FIG. 2 illustrates a graph showing a trajectory of a whirlybird intercepting projectile and a target projectile and the process of interceptor projectile deployment and interception.

The trajectory of the whirlybird concept for intercept is illustrated in FIG. 2. Similar to FIG. 1, the trajectory of the incoming projectile is shown. The trajectory of the whirlybird is shown on the left. Note that after an initial acceleration (not shown) there is a longer period of deceleration.

Here the function of the airscrew is to transfer the angular momentum (from launch) of the projectile to linear momentum by energizing the axial flow though the blades. The transfer drag slows the rotation of the propellers, which in turn provides transferred momentum to overcome the aerodynamic drag of linear motion. The end result is a continuous slowing of both rotational and linear velocity of the interceptor.

The whirlybird interceptor is designed such that during the intercept time, the linear velocity is low enough but the rotational velocity is still high enough to guarantee a hit. For this reason, the number of propeller arms should to be more than the previous embodiment and the possibility of employing more than one layer of propellers that are positioned at a predetermined distance from each other. A directional charge would also be more appropriate compared to a plain charge since the point of interception is close to the object being protected.

A number of design are possible, such as (1) To increase the distance traveled, the interceptor can be fired to provide some initial linear momentum, and/or (2) Depending upon the firing speed, the airscrews may still act as propellers or may act as a windmill decelerating the interceptor from launch.

As pictured in FIG. 2, the propellers must be in front of the center of gravity for longitudinal stability (The propellers pull the interceptor through the air).

The design parameters are: (1) Initial torque; (2) Initial linear velocity; and (3) the number of blades. In addition, the pitch of the blades may be allowed to change (decrease) with time, so as to keep the rotation speed high by minimizing the rotational drag.

The primary advantages of the whirlybird type of interceptors are that: (1) Because of the increased cross section, a less sophisticated aiming mechanism is needed; (2) No actuators or on board electronics are necessary; (3) No tracking of interceptor is required; (4) Only detection of incoming projectile is required; and (5) A bank of such devices could be fired simultaneously.

In general and similar to any other protective weapon, the effectiveness of the weapon is increased if the target is rapidly spotted and the intercepting projectiles are fired in its direction as accurately as possible. Since the primary objective of the projectile interceptors, a list of possible launch platforms and their mode of operation are briefly described. Here, the objective is that the development of launch platforms can be rather routine, even though some of the options are technologically challenging. The latter statement is believed to be justified since other similar platforms with even more strict requirements have in the past been developed by the military.

The options available for the launch platforms include the following: (1) Multiple launch tubes (barrels) are mounted radially over a relatively slow but fast enough rotating (in the horizontal plane) platform. By having multiple launch tubes positioned a short angular distance from each other, the platform has to only be rotated a few degrees to direct the interceptor in the direction of the incoming target. The pointing becomes even faster since the platform does not have to be stopped for firing. A number of launch tubes may also be stacked at each location; (2) Similar to the previous platform with the difference that the platform is continuously rotating. As the result and by having enough launch tubes in the radial direction, one of the launch tubes will be pointing in the appropriate direction for firing almost instantaneously; (3) A fixed set of launch tubes may be directed in the directions of maximum threat. This is particularly appropriate for stationary objects or objects that are not moving and have positioned themselves in a position in which there are only limited directions from which they would be threatened. Such platforms may, for example be set up all around a camp to protect the interior assets from incoming threats; (4) All the above launch platforms may be equipped with guns that fire multiple rounds very rapidly. The platforms may also be equipped with radar or other target sensing and fire control systems.

Figure 3:
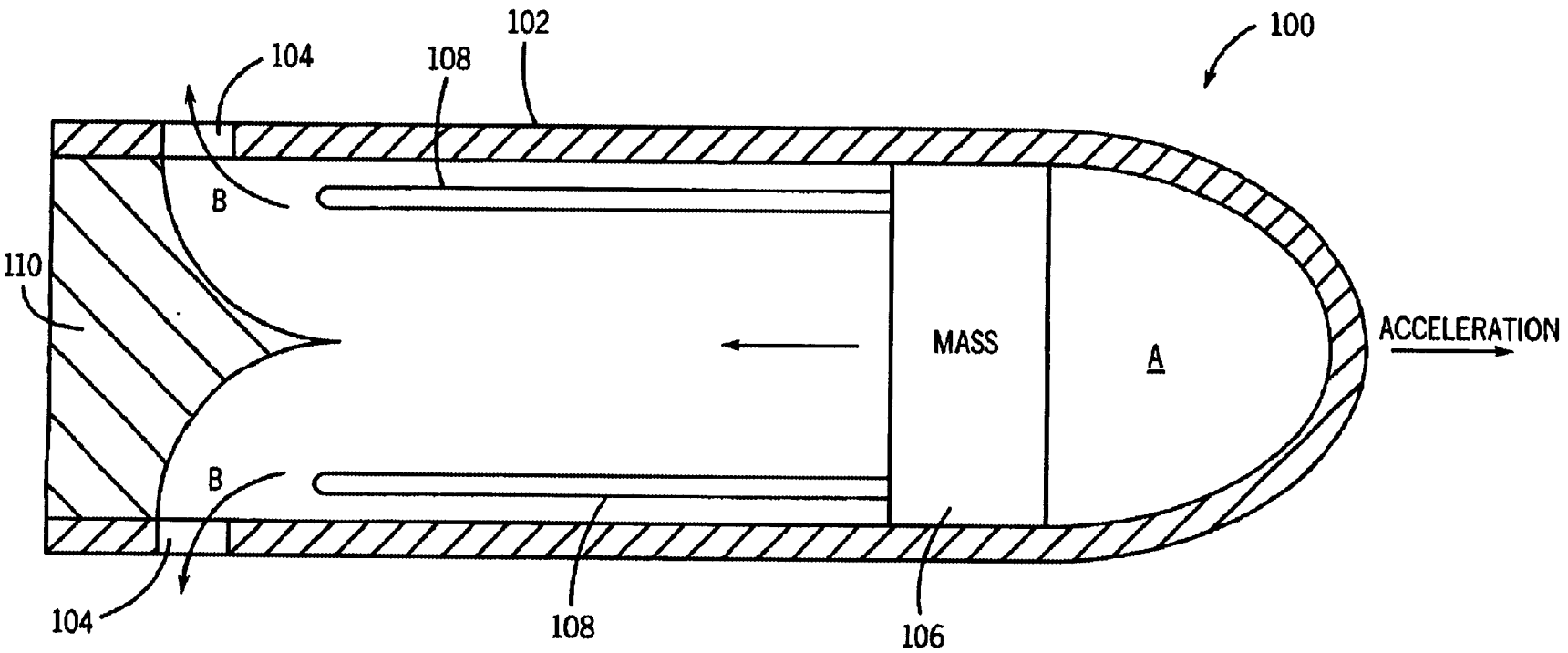
FIG. 3 illustrates a first implementation of a deploying means for an interceptor projectile of the present invention.
Figure 4:
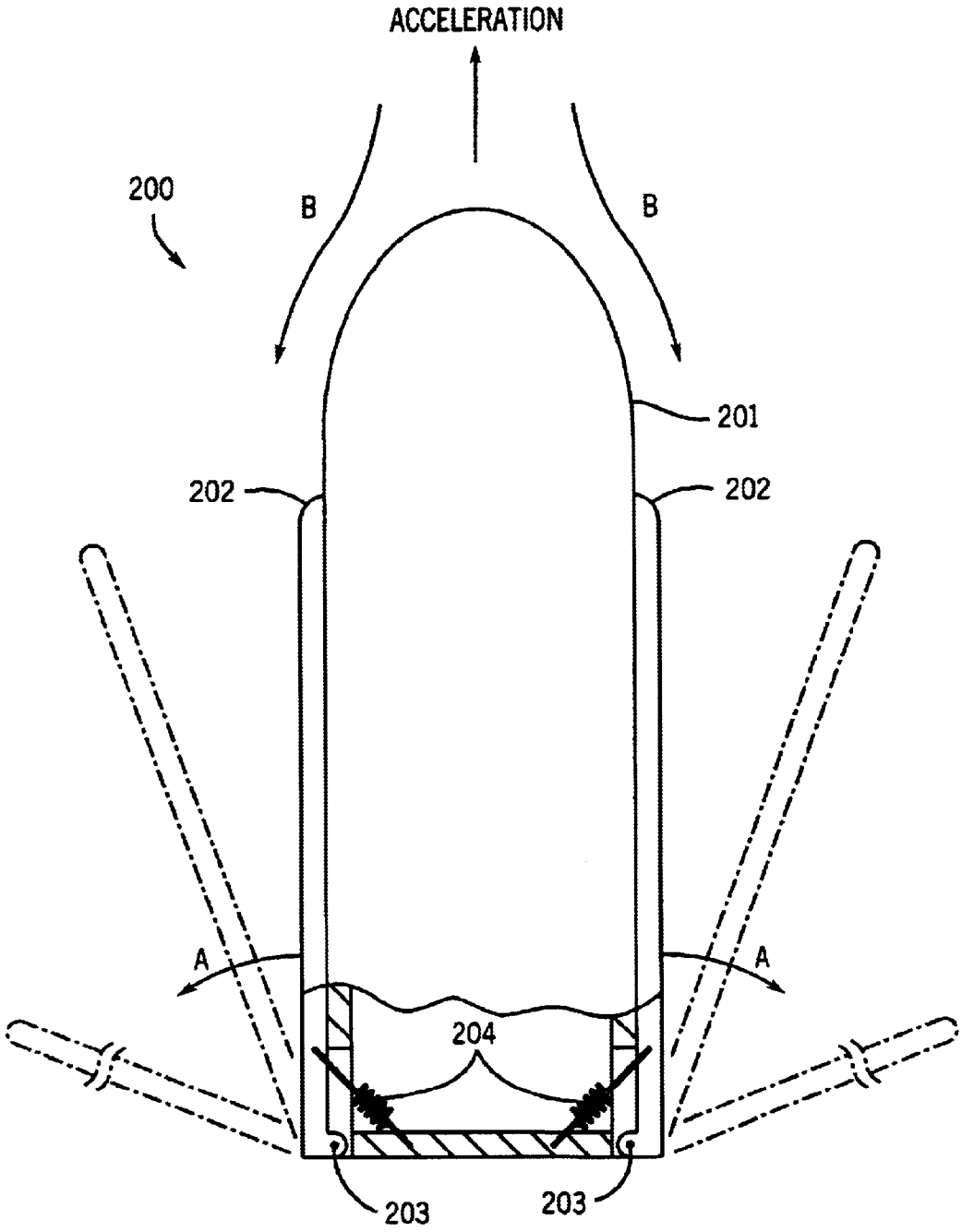
FIG. 4 illustrates a second implementation of a deploying means for an interceptor projectile of the present invention.

Referring now to FIGS. 3 and 4, alternative implementations for deploying the blades of a projectile are shown. Referring first to FIG. 3, a purely mechanical means for deploying the blades is shown. FIG. 3 shows a projectile 100 having a shell 102 with slots 104. In the interior of the projectile 100 is housed a slidable mass 106 having flexible blades 108 depending therefrom towards the rear of the projectile 100. Upon firing of the projectile 100, the acceleration of the projectile causes the mass 106 to move relative to the shell towards the rear of the projectile. As the mass 106 moves rearward, a block 110 forces the flexible blades 108 to enter the slots 104 and deploy from the shell 102. The block can also be shaped to also twist the blades 108 as they deploy to facilitate either propelling or slowing of the projectile 100. A damping means (not shown) may be added to slow the acceleration of the mass 106 resulting in a slowing of the deployment of the blades 108. Further, a similar arrangement can be used without using the acceleration of the projectile 100 to deploy the blades 108. For instance, a charge can be detonated in the vicinity of area A to drive the mass rearward. The charge can be detonated at the time of firing or at a predetermined time interval after firing.

Referring now to FIG. 4, there is shown a projectile having deployable blades according to a second implementation of the present invention, the projectile illustrated in FIG. 4 being generally referred to by reference numeral 200. In the projectile 200, the blades 202 are held against a portion of the projectile shell 201 prior to firing, preferably by a firing tube (not shown). The blades 202 are rotatably disposed on the shell 201 of the projectile 200, preferably by simple pivot joints 203. Upon firing, the projectile 200 exits the firing tube and the blades 202 are biased outward in the direction of Arrow A by biasing springs 204, which are preferably torsional springs located about each respective pivot 203. The airflow B around the projectile continues to open the blades until fully deployed (dashed lines). Stop means (not shown) can be provided to limit the opening of the blades to an appropriate position. Furthermore, a locking mechanism, such as a ratcheting mechanism (not shown) can be provided at the pivot joints 203 to prevent the blades 202 from closing once they have opening.

In yet another alternative implementation, the projectile 200 of FIG. 4 can be rifled (spun, typically by providing a helical groove in the bore of the firing tube). The centrifugal force of the blades 202 caused by the spinning would further aid in deploying the blades 202. In such a configuration, the biasing springs 204 may be eliminated.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for protecting a second location against a first projectile fired from a first location at the second location, the method comprising:

firing at least one second projectile toward the first projectile; and deploying one or more projections from the second projectile to increase its footprint and increase the probability of destroying or changing the trajectory of the first projectile.

2. The method of claim 1, further comprising tracking the first projectile and directing the at least one second projectile towards the first projectile.

3. The method of claim 1, wherein the deploying step deploys two or more air blades to either hover the second projectile or propel it towards the first projectiles.

4. The method of claim 1, wherein a plurality of second projectiles are fired toward the first projectile.

5. The method of claim 1, further comprising detonating a charge on a surface of at least one of the one or more projections which makes contact with the first projectile.

6. An interceptor projectile for protecting a second location against a first projectile fired from a first location at the second location, the interceptor projectile comprising:

a shell;

one or more deployable projections movably support by the shell between closed and deployed positions; and deploying means for deploying the one or more projections to increase the footprint of the interceptor projectile and increase the probability of destroying or changing the trajectory of the first projectile;

wherein the one or more projections comprises two or more air blades, wherein the means for deploying comprises means for deploying the two or more air blades to either hover the interceptor projectile or propel it towards the first projectiles.

7. An interceptor projectile for protecting a second location against a first projectile fired from a first location at the second location, the interceptor projectile comprising:

a shell;

one or more deployable projections movably support by the shell between closed and deployed positions; and deploying means for deploying the one or more projections to increase the footprint of the interceptor projectile and increase the probability of destroying or changing the trajectory of the first projectile; and a plurality of interceptor projectiles fired toward the first projectile.

8. An interceptor projectile for protecting a second location against a first projectile fired from a first location at the second location, the interceptor projectile comprising:

a shell;

one or more deployable projections movably support by the shell between closed and deployed positions; and deploying means for deploying the one or more projections to increase the footprint of the interceptor projectile and increase the probability of destroying or changing the trajectory of the first projectile; and an explosive charge disposed on a surface of at least one of the one or more projections and means for detonating the explosive charge upon contact with the first projectile.

9. An interceptor projectile for protecting a second location against a first projectile fired from a first location at the second location, the interceptor projectile comprising:

a shell;

one or more deployable projections movably support by the shell between closed and deployed positions; and deploying means for deploying the one or more projections to increase the footprint of the interceptor projectile and increase the probability of destroying or changing the trajectory of the first projectile;

wherein one or more projections are rotatably disposed on the shell and the deploying means comprises biasing means for pivoting the one or more projections outward radially after firing from a firing tube.

10. An interceptor projectile for protecting a second location against a first projectile fired from a first location at the second location, the interceptor projectile comprising:

a shell;

one or more deployable projections movably support by the shell between closed and deployed positions; and deploying means for deploying the one or more projections to increase the footprint of the interceptor projectile and increase the probability of destroying or changing the trajectory of the first projectile;

wherein the deploying means comprises means for centrifugally deploying the one or more projections upon the spinning of the shell.

11. An interceptor projectile for protecting a second location against a first projectile fired from a first location at the second location, the interceptor projectile comprising:

a shell;

one or more deployable projections movably support by the shell between closed and deployed positions; and deploying means for deploying the one or more projections to increase the footprint of the interceptor projectile and increase the probability of destroying or changing the trajectory of the first projectile;

wherein the deploying means comprises:

the one or more projections being slidably disposed in a cavity of the shell and being fabricated from a flexible material;

at least one weight slidable with the one or more projections;

a slot corresponding to each of the one or more projections, the slots being disposed on an exterior of the shell and in communication with the cavity; and directing means for propelling and directing the flexible blades from the cavity and through the slots to project from the shell upon firing of the interceptor projectile.

12. The interceptor projectile of claim 11, wherein the directing means comprises a curved portion disposed in the cavity and proximate to the slots, the curved portion having a curved surface which directs each of the projections to a corresponding slot, the weight being slidable towards the slots upon acceleration of the interceptor projectile.

13. The interceptor projectile of claim 11, wherein the directing means comprises a curved portion disposed in the cavity and proximate to the slots, the curved portion having a curved surface which directs each of the projections to a corresponding slot, the weight being slidable towards the slots upon detonation of a charge.

* * * * *